United States Patent [19]

Thill

[11] Patent Number: 4,531,475

[45] Date of Patent: Jul. 30, 1985

[54] ARTICLE DECORATING DEVICE

[75] Inventor: Gerald D. Thill, Eden Prairie, Minn.

[73] Assignee: Spearhead Industries, Inc., Minneapolis, Minn.

[21] Appl. No.: 599,258

[22] Filed: Apr. 11, 1984

Related U.S. Application Data

[63] Continuation-in-part of Ser. No. 406,317, Aug. 9, 1982, abandoned.

[51] Int. Cl.[3] ..... B05C 13/02; B05C 17/08

[52] U.S. Cl. ..... 118/503; 118/505; 118/13; 427/282; 101/35; 101/126

[58] Field of Search ..... 118/13, 503, 504, 505, 118/500; 427/282, 286; 33/21 R, 21 D; 426/298, 300, 301; 101/114, 35, 126

[56] References Cited

U.S. PATENT DOCUMENTS

| | | | |
|---|---|---|---|
| 734,085 | 7/1903 | O'Mara | 118/505 X |
| 1,400,124 | 12/1921 | Wolverton | 101/35 |
| 2,014,373 | 9/1935 | Brickell, Jr. | 101/126 |
| 2,105,378 | 1/1938 | Smith | 101/35 X |
| 2,851,374 | 9/1958 | Dombrowski | 101/126 X |
| 3,185,471 | 5/1965 | Coll-Palagos | 118/505 X |
| 3,957,371 | 5/1976 | Rich | 118/504 X |

FOREIGN PATENT DOCUMENTS

| | | | |
|---|---|---|---|
| 682874 | 10/1939 | Fed. Rep. of Germany | 101/114 |
| 646394 | 11/1950 | United Kingdom | 101/35 |

OTHER PUBLICATIONS

Eastern Unlimited TM brochure, 1983.

*Primary Examiner*—Norman Morgenstern
*Assistant Examiner*—Bernard F. Plantz
*Attorney, Agent, or Firm*—James R. Cwayna

[57] ABSTRACT

An article decorating device, particularly for the decorating of eggs, having a formed, article receiving and cushioning surface, a slotted and formed or formable template receivable over the article to be decorated and a cover member arranged to be positioned over the article and template to positively hold the same in position with respect to one another and to the receiving surface during the decorating process. The template is selectively provided with apertures or slots therethrough to permit decorating devices such as pens to extend therethrough for contacting and applying decorating materials to the article.

3 Claims, 4 Drawing Figures

ARTICLE DECORATING DEVICE

STATUS

This application is a continuation-in-part of the application entitled Article Decorating Device, filed Aug. 9, 1982, Ser. No. 06/406,317 now abandoned.

FIELD OF THE INVENTION

This invention relates generally to the art of decorating articles, particularly eggs and more specifically is directed to a unit for initially positioning the article to be decorated upon a receiving or cushioning surface, positioning a template having apertures or slots thereover with the cover member arranged to positively hold the template with respect to the article while decorating devices such as pens are used to apply the decorating material through the template.

BACKGROUND AND OBJECTS OF THE INVENTION AND PRIOR ART THEREFORE

The art of decorating eggs and other articles has been practiced for centuries. The most artistic method of decoration is known as the Ukranian method. This particular method includes many steps of waxing and coloring and wax removal to arrive at the final design. There are also mechanical devices for the mounting and turning of the eggs during decorating such that the egg is rotated past a stationary or moveable stylus or pen mounting device.

In the applicant's consideration of the prior art, he has failed to find any unit particularly directed to egg decorating which provides an article holding or positioning bed which bed may be of a cushioning material, an apertured or slotted template to overlie the egg, the template being formed or formable to conform to the general shape of an egg and a cover means to positively position and hold the egg and the template against the cushioning bed such that the egg is held and pens or other coloring devices will extend through the template openings for decorating contact with the egg.

The applicant's device further includes the elements for decorating, including decorating pens as a supplied kit.

The prior art, to the best of the applicant's knowledge only includes prior art references as cited by the U.S. Patent Office during the initial prosecution of the original application for patent on this device. Such prior art is represented by U.S. Pat. Nos. 2,105,378, 2,851,374, 734,085 and 3,185,471 and German Pat. No. 682,874 and British Pat. No. 646,394. It should be noted that none of these references even vaguely suggests the decorating of eggs or, for that fact, an article that could be considered to be of a delicate nature.

U.S. Pat. No. 2,851,374 to Dombrowski is directed to a silk screening device for the application of a paste to a flat surface. This patent is method which is necessary for the material being processed and does not relate to any formable template, cushioning and receiving bed nor separable cover for the elements.

U.S. Pat. No. 3,185,471 is directed to a finishing unit for controlled finishing of precise areas of an article. Exact registration of the article is the main concern of the invention and although the article to be finished is mentioned as consisting of planar and curved surfaces, the template is of, and is described as being of a flat surface.

U.S. Pat. No. 734,085 is directed solely to a device for the striping and spotting of pool balls and consists of a clamping element for positively clamping the ball for spotting and striping. The clamping unit as shown and described therein includes a hinged die member having a locking catch. The only concerning this reference gives to a cushion element is a cushion block arranged between an arm of the clamp and the die contacting the ball to permit ample freedom of movement to the die to seat itself upon the surface of the ball. The cushion is not provided to rest against or contact the ball.

U.S. Pat. No. 2,105,378 is directed to a unit for stencilling or decorating while rotating the article. As particularly illustrated, this unit is a moveable silk screen device with the wiper being of the same configuration as the stencil screen. As stated, the applicant is aware of a similar unit for decorating eggs which provides for rotation of the egg past a stationary or selectively moveable stylus.

From a simple consideration of structures, it is obvious that the clampable units for any rotatable mounting of an article must encompass a considerable number of cooperative mechanisms which are eliminated with applicant's unit.

British Pat. No. 646,394 provides the structure for transferring a design from a preprinted sheet to an article. In this instance the preprinted sheet is a flexible sheet of rubber which shen bearing the ink is distended by air pressure to form against the article and transfer the ink to the same. The element receiving the article to be decorated is provided of a mouldable material into which the article may be pressed and thereby held.

The German Pat. No. 682,874 provides a rotatable base upon which a hemispherical mold is provided, this mold being provided with decorating apertures, and locating pins to receive a second hemispherical mold placed over the article and similarly being provided with decorating apertures. This patent simply provides a two piece, preformed mold for holding an article and which mold may be rotated past a color or decorating application unit.

As a basic consideration, applicant does not believe that any of this art is useable for providing the device he has provided.

It is an object of the applicant's invention to provide an article, particularly an egg, decorating device which includes an article receiving member, a formable or preformed template for placement over the article and a cover member arranged to register and hold the template to the article and the article to the receiving member.

It is a further object of the applicant's invention to provide an egg decorating device which includes a surface to receive the egg and support the same during decorating, a template having a plurality of apertures therethrough and a cover member arranged to position the template with respect to the article while permitting the application of decorating devices through the template against the surface of the egg.

It is still a further object of the applicant's invention to provide a device for the decorating of articles, particularly eggs, which includes a housing having a base and lid, the base including a support for the egg during decorating, a template receivable over the article and arranged between the base and lid when in decorating position and the cover or lid being provided with an aperture therethrough which permits access to the template and allows the application of coloring to the article through the template.

These and other advantages and objects of the invention will be become obvious upon a consideration of a short summary of the invention, a description of the drawings of the same and a detailed description of the form of the invention illustrated.

SHORT SUMMARY OF THE INVENTION

A device for the decorating of eggs, such as Christmas or Easter eggs, which device may be provided as a kit for complete containment of the elements of the kit and which includes a support base, a designed and apertured template for covering an egg received upon the base, and a cover member having an access area therethrough which will expose the apertured portion of the template while holding the same to the support base whereby the template and egg are registered and which permits application of decorating pens or the like to the surface of the egg through the template. Ideally, the unit may be provided as a container box for housing the elements for decorating, the templates and other decorating articles with the base providing the housing area of the box and the cover providing a closure element for same with the template access provided through the cover.

DESCRIPTION OF A PREFERRED FORM OF THE INVENTION

Figure 1:
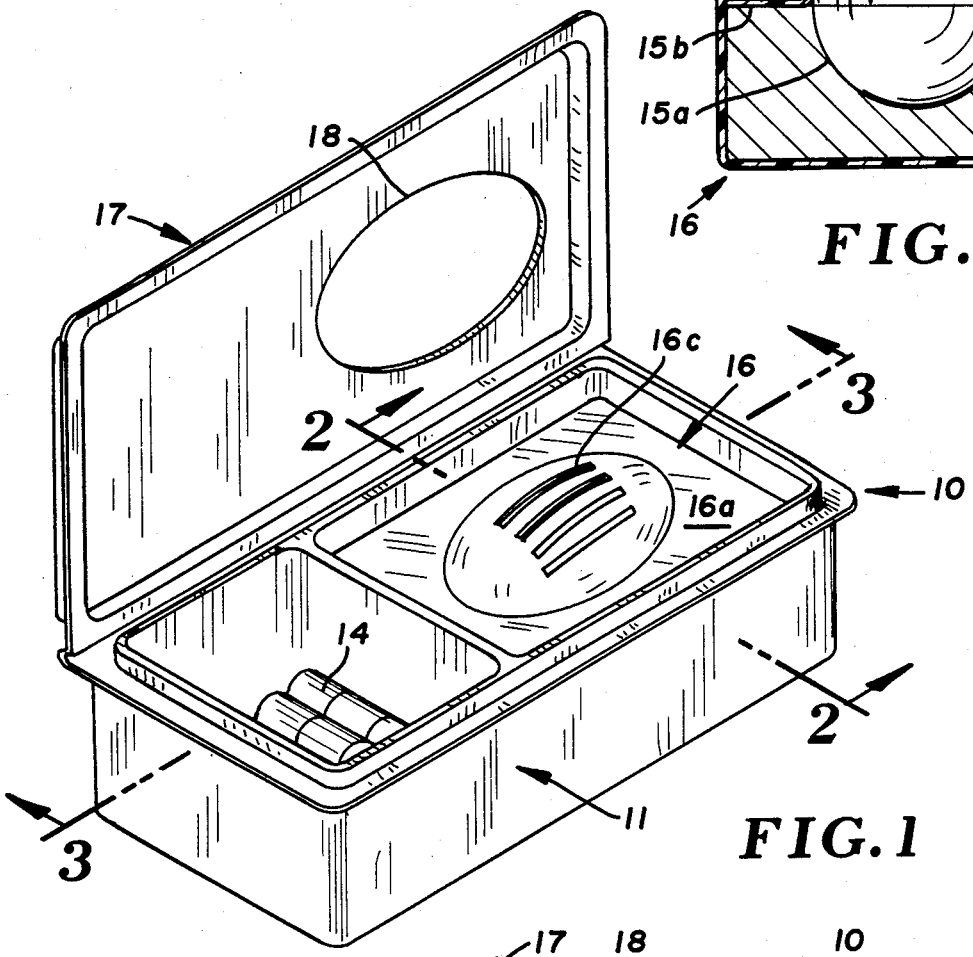
FIG. 1 is a perspective view of a container unit, in open position, which illustrates the invention in kit form with all of the elements for decorating eggs being illustrated therein.
Figure 2:
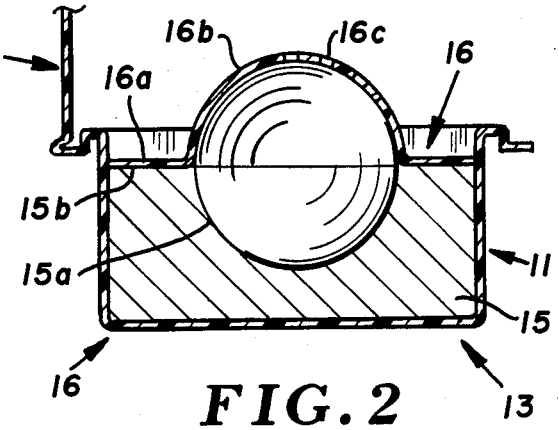
FIG. 2 is a vertical section take substantially along Line 2—2 of FIG. 1.
Figure 3:
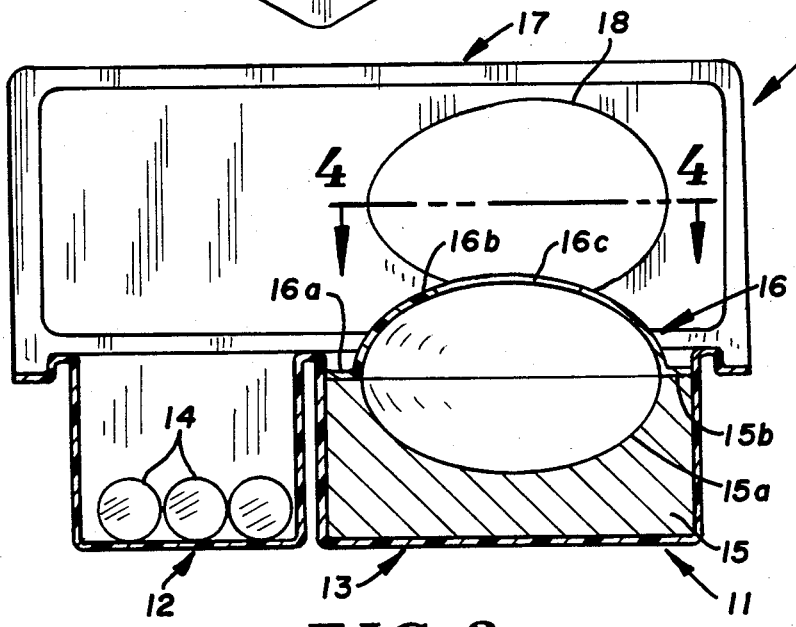
FIG. 3 is a vertical section taken substantially along Line 3—3 of FIG. 1; and, FIG. 4 is a horizontal section taken substantially along Line 4—4 of FIG. 3.
Figure 4:
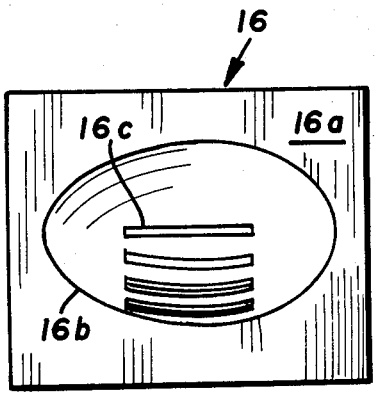

In accordance with the accompanying drawings, the device of the applicant's invention is illustrated in a saleable, kit form and is generally designated 10. In this form of the invention, the kit provides a housing for all of the various elements that may be utilized in the decoration of eggs which elements may include pens, stencils, dyes, pencils, transfers, etc. In the form shown, the housing 10 provide two receiving areas 11, 12. The first of such areas 12 provides a compartment to receive coloring devices such as pens, crayons or other elements. It should be stated that, although the device would normally be provided with this compartment area 12, it is not essential to the invention that this portion be so provided. Arranged adjacent the compartment 12 is a second receiving area or compartment 13 and this compartment is, in the form shown, provided with an article receiving member 15 designed for cushioning receipt of the article. It should be noted that, although member 15 is illustrated as an individual unit received into compartment 13, this member may be integrally formed as a portion of the kit 10 and, in practice, the two receiving areas 12, 13 are formed in adjacent relation into a common lower base member 11 and this entire unit may be formed in a single operation and the desired shape of receiving area 13 may be provided at formation to thereby eliminate member 15.

Whether article 15 is provided or area 13 specifically formed, a concave area 15*a* is provided to receive an egg and a registration surface 15*b* is provided at the upper edge thereof which surface 15*b* corresponds to the approximate one-half of the egg and such surface 15*b* serves as an abutment surface to receive template 16 thereagainst.

In the form shown, a template, or a series of selected templates 16 are provided and are of a size to be received into the receiving area 13 and such templates 16 are provided with an extending shoulder portion 16*a* to abut with the aforementioned surface 15*b* of area 13. As illustrated, the template 16 is provided with a curved, oblate surface 16*b* to conform to the approximate shape of the egg positioned in concave area 15*a* and, the template 16, being formed of a relatively flexible material will be conformable to the surface of an egg. As illustrated, a plurality of decorating apertures 16*c* are formed through the oblate area 16*b* of template 16 for the introduction of decorating pens or the like therethrough to allow for the application of dyes, inks, etc. to the surface of the egg.

For purposes of practicality and particularly when providing a complete kit, a cover member 17 is hingedly attached to one side of base member 11 for closure over the entire base member 11. Obviously, various ledges or the like may be provided for registration of such cover 17 with the base 11 and such elements are not specifically described. The most important aspect of the cover member 17 is the aperture 18 formed therethrough which aperture 18 provides access to the template 16 and thereby allows application of decorations to the egg arranged thereunder. It should be noted that the aperture 18 and oblate surface 16*b* of the template 16 provide for registration between such elements.

The cover 17 may also be provided with cooperative latching elements to engage with similarly provided elements on the lower base portion 11 for connective closure of the same whether the same be used as a cover member for the unit as a kit or for purposes of decorating an egg.

The template 16 is illustrated with a plurality of slots 16*c* therethrough. These slots are purely examples of various forms of stencilling decorations that are available for use and these would depend upon the particular season or event for which the unit is created and sold.

The use of the unit should be obvious. A prepared egg is placed on receiving surface 15*a* and a template, as desired, is selected and placed thereover and lid member 17 is closed over then entire combination. Following closure, the oblate surface 16*b* of template 16 allows the surface of the egg to be accessible for decorating by use of pens 14 which may be, as stated, provided in compartment 12. It should be obvious that this arrangement allows decoration of only a portion of the egg and the same must be rotated for further decoration.

As stated, it is not necessary that both compartmented areas of the lower base unit be provided for the decoration process. For decoration, it is only necessary to provide the egg receiving compartment 13, template 16 and a portion of the lid 17 which provides the access opening 18.

It should be obvious that the applicant has provided a new and unique device for the decorating of eggs which provides a means for effectively holding the eggs and a decorating template for applying the coloring to the eggs.

What is claimed is:

1. A device for the decorating of eggs, such device including:

a. a base portion providing an egg receiving and support section which support section is arranged and constructed to receive at least a portion of the egg to be decorated therein and providing registration means;

b. an apertured template conformable to the shape of an egg and arranged to overlie the egg to be decorated and arranged and constructed to engage said registration means, said apertures being provided for the introduction of decorating devices therethrough to contact the surface of the egg positioned on said base;

c. template receiving and holding means hingedly attached to said base portion, including a passage therethrough permitting said apertured area of said template to pass therethrough; and, d. said template holding means and said template being separable, said holding means being arranged and constructed to contact said apertured template to urge the same into registration with said base portion.

2. The device as set forth in claim 1 and said template receiving and holding means including cover means arranged and constructed to form a container with said base portion.

3. The device as set forth in claim 1 and said base portion providing said egg receiving and support section and a second article receiving section, said means to urge said template including a cover section normally overlying said article receiving section when the same is in position over said template and base portion.

* * * * *